US005268718A

United States Patent [19]

Maeda et al.

[11] Patent Number: 5,268,718

[45] Date of Patent: Dec. 7, 1993

[54] DEVELOPING DEVICE

[75] Inventors: Masahiko Maeda, Osaka; Kisaku Koshijima, Hyogo; Masao Uyama, Osaka, all of Japan

[73] Assignee: Mita Industrial Co., Ltd., Osaka, Japan

[21] Appl. No.: 881,713

[22] Filed: May 12, 1992

[30] Foreign Application Priority Data

May 13, 1991 [JP] Japan ..... 3-106996

[51] Int. Cl.[5] ..... G03G 15/06

[52] U.S. Cl. ..... 355/245; 118/656

[58] Field of Search ..... 355/245, 259; 118/656, 118/653

[56] References Cited

U.S. PATENT DOCUMENTS 4,254,202 3/1981 Matsumoto et al. ..... 118/653 X 5,019,867 5/1991 Yamakawa et al. ..... 355/245

*Primary Examiner*—A. T. Grimley

*Assistant Examiner*—Nestor R. Ramirez

*Attorney, Agent, or Firm*—Koda and Androlia

[57] ABSTRACT

A developing device constructed such that a rotational axis of a transmission gear which is engaged with a gear attached to the photosensitive drum of an image forming apparatus is fixed in relation the photosensitive drum gear in order to transmit the rotational force of the photosensitive drum to the developing roller via gears, and at the same time the transmission gear axis is rockably suspended and supported as a supporting axis of the developing unit, the developing roller gear is linked with a transmission gear by means of a plurality of gears, and a force which acts to keep the developing unit away from the photosensitive drum is decreased.

6 Claims, 3 Drawing Sheets

DEVELOPING DEVICE

BACKGROUND OF THE INVENTION

1. Field of the Invention

The present invention relates to a developing device in an image forming apparatus of an electronic photography process for a copying machine, a printer, etc.

2. Description of the Prior Art

In an image forming apparatus in electronic photography process, a developing device for image forming related to electrostatic latent images of document images imaged on a photosensitive drum by adsorbing a developing agent from a developing roller which rotates contiguously thereto utilizes various means, depending upon the kind of developing agent and the developing system. However, it is general that developing is carried out at a developing treatment unit formed between the photosensitive drum and the developing roller as described above. At this time, it is important that the interval or contact pressure between the developing roller and the photosensitive drum does not fluctuate, and excessive fitting contact pressure must not be given to the photosensitive drum.

FIG. 4 shows a developing device disclosed in the Japanese Patent Publication No. SHO 63-67185 as one of the examples of conventional units for forming a developing device as described above. A developing roller 5 disposed in the vicinity of a photosensitive drum 1 is integrally constructed with a hopper 8 which accommodates a developing agent 9 and is suspended and supported as developing unit 4, which is confronted to the photosensitive drum 1, by a suspending member 11 with a pin 10 used as axis. The developing unit 4 is constructed so that it can be pressed to the photosensitive drum 1 by its self-weight and energizing springs 12, 13 and is given transmission of drive force by engagement of a gear 3 fixed at the photosensitive drum 1 and a gear 6 of the developing roller 5.

In the above conventional construction, the developing unit 4 which is suspended and supported is likely to generate torque in the direction of keeping the developing unit 4 away from the development treatment portion due to rotational drive to such a degree as the larger the torque becomes because there is a distance between the supporting axis and the drive transmission portion to which drive force is transmitted, and there is such a problem as the interval of the developing unit consisting of the developing roller 5 and the photosensitive drum 1 fluctuates. As the interval between the photosensitive drum 1 and the developing roller 5 is kept away, the developed image is made to be white blanked, and on the other hand, as a compression force by which the developing roller 5 is charged to the side of the photosensitive drum 1 in order to suppress this torque of keeping away is strengthened, excessive load is given to the photosensitive drum 1 to damage the photosensitive body, thereby a problem which produces strain or distortion at the developing unit 4 is caused to be present.

SUMMARY OF THE INVENTION

In view of the above problems, it is therefore an object of the present invention to provide a developing device which can carry out transmission of the rotation drive force, with the distance of the development treatment portion formed with the developing roller and the photosensitive drum kept in a stabilized status.

In order to achieve the above object, the developing device of the present invention is designed so that rotational force of the photosensitive drum is transmitted to a developing roller supported at a developing unit arrayed confronting to the photosensitive drum, and is characterized in that a drum gear which rotates integrally with the photosensitive drum arranged coaxially with a rotational axis of the photosensitive drum is provided on the side wall of the photosensitive drum; a transmission gear which is directly engaged with the drum gear is rotatably supported at a supporting axis arrayed in parallel to and spaced from the rotational axis of the photosensitive drum; the developing unit confronting to the photosensitive drum is rockably axially supported at the supporting axis; a roller drive gear which is arranged coaxially with the rotational axis of the developing roller and rotates integrally with the developing roller is provided on the side wall of the developing unit at the side to which the transmission gear of the developing unit is attached; an odd number of gears which link between the roller drive gear and the transmission gear are rotatably provided on the side wall of the developing unit at the side to the transmission gear and roller drive gear are attached; and energizing means which energizes the developing roller toward the photosensitive drum is provided at the developing unit. According to the present invention, it is designed that a rotary axis of the gear to which drive force is transmitted from the photosensitive drum is used as supporting axis of the developing unit and a development treatment portion consisting of the developing roller and the photosensitive drum is formed according to the degree of freedom of rotation centering around the supporting axis. Therefore, as the supporting axis and the drive force transmission axis are identical to each other, the torque with which the developing unit is tried to keep away from the photosensitive drum by rotational drive is small, and the developing unit can be retained and kept in a stabilized status.

On the other hand, as the drive force which causes the developing roller to rotate is transmitted via a gears train consisting of a plurality of gears from the supporting axis gear to which drive force is transmitted from the photosensitive drum, position holding of the developing unit and transmission of the drive force are do not interfere with each other, and the interval fluctuation of the developing unit is decreased.

DETAILED DESCRIPTION OF THE PREFERRED EMBODIMENTS

Figure 1:
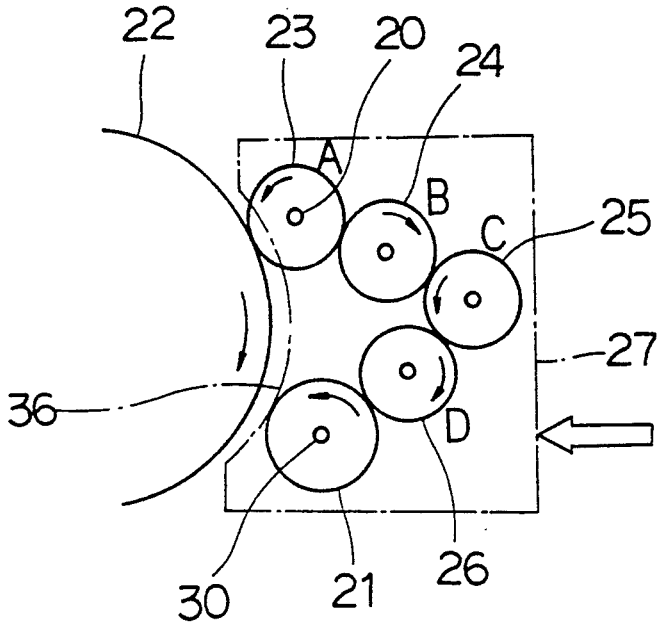
FIG. 1 is a simulated view showing a construction of a preferred embodiment according to the present invention.
Figure 2:
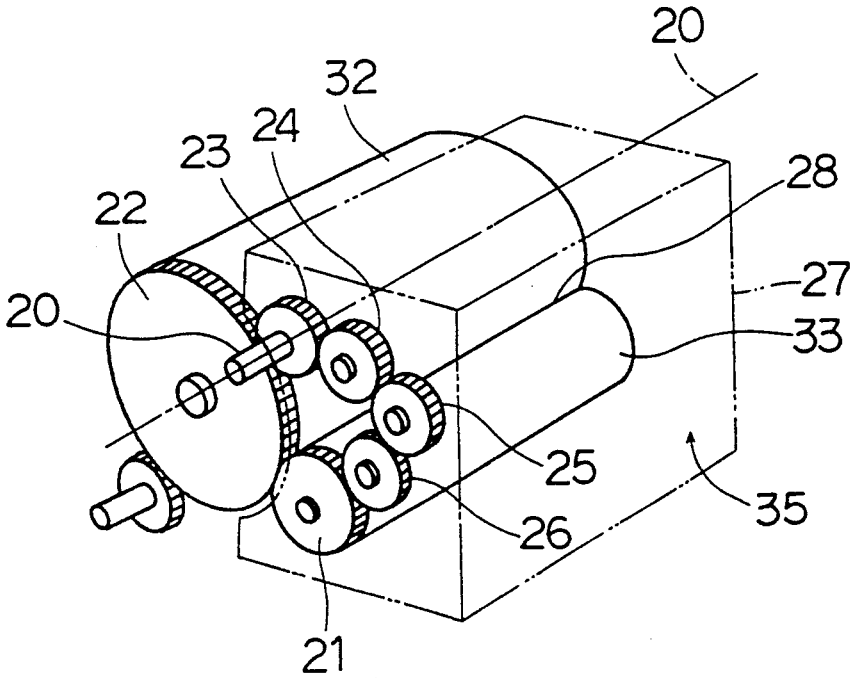
FIG. 2 is a perspective view thereof, FIG. 3 (*a*) is a conventional example, and FIG. 3 (*b*) is a descriptive view showing the actions of the preferred embodiment.

A preferred embodiment of the present invention is described with reference to the drawings. FIG. 1 and FIG. 2 show a construction of a developing device according to the present invention.

The preferred embodiment is an example relating to a direct compression type developing system, using a one constituent developing agent, in which the developing agent is formed to be thinly film-like on the surface of the developing roller and is adsorbed to an electrostatic latent image on the photosensitive drum which rotates in confronting thereto.

In FIG. 1 and FIG. 2, a drum gear 22 which is coaxially integral with the photosensitive drum 32 is arranged on the side wall of the photosensitive drum 32. Drive input to the photosensitive drum 32 is transmitted to a transmission gear 23 of a supporting axis 20 of the developing unit 35 directly engaged with the drum gear 22 of the photosensitive drum 32 and further is transmitted to the roller drive gear 21 of the developing roller 33 by an odd number of gears 24, 25, 26. Furthermore, the transmission gear 23 is rotatably mounted to the supporting axis 20, and the gears 21, 24, 25, 26 are rotatably provided at the side wall on which the transmission gear 23 of the developing unit 35 is attached. Also, the gears 24 and 26 are arrayed to be hook-like, centering around the gear 25.

The developing unit 35 which is confronted to the photosensitive drum 32 and has a recess 36 accommodating the photosensitive drum 32 is constituted by accommodating developing agent feeding means (not illustrated) and a developing roller 33 in a casing 27, and the casing 27 is rockably suspended and supported by the supporting axis 20 of the developing unit 35. The developing roller 33 rotates by way of the rotational drive system and forms a development treatment portion 28 between the photosensitive drum 32. Thus, it makes a developing agent to be adsorbed onto electrostatic latent images on the surface of the photosensitive drum 32 and the images can be developed.

As observed in the direction perpendicular to the photosensitive drum 32, the supporting axis 20 is installed so that it is closely contacted to the surface of the upper portion of the photosensitive drum 32, i.e., offset toward the side of the photosensitive drum 32. And as the developing unit 35 is suspended and supported by the supporting axis 20, the developing roller 33 is forced to the side of te photosensitive drum 32 by its self weight. However, as the pressure contact may fluctuates according to the rotational drive, the developing unit 35 is given an adequate pressure contact force by adequate energizing means like a spring, etc., thereby causing a specified pressure contact force to be applied to the developing treatment portion 28. As for torque which tries to keep the developing unit 35 away from the photosensitive drum 22 by rotational drive force, the torque arm is small as the supporting axis 20 and the drive force transmission axis are located at the same position. Therefore, a pressure contact force for pushing the developing unit 35 to the side of photosensitive drum 22 may be slight.

Furthermore, as a rotational drive force is transmitted to the developing roller 33 by a train of gears 24, 25, 26, the direction of the rotational drive force is dispersed by means of each of the gears, thereby causing the torque of keeping the developing roller 33 away from the development treatment portion 28 to be weakened, and the fluctuation of fitting contact pressure of the development treatment portion 28 is small. Thus, stabilized image formation can be carried out.

Figure 3A:
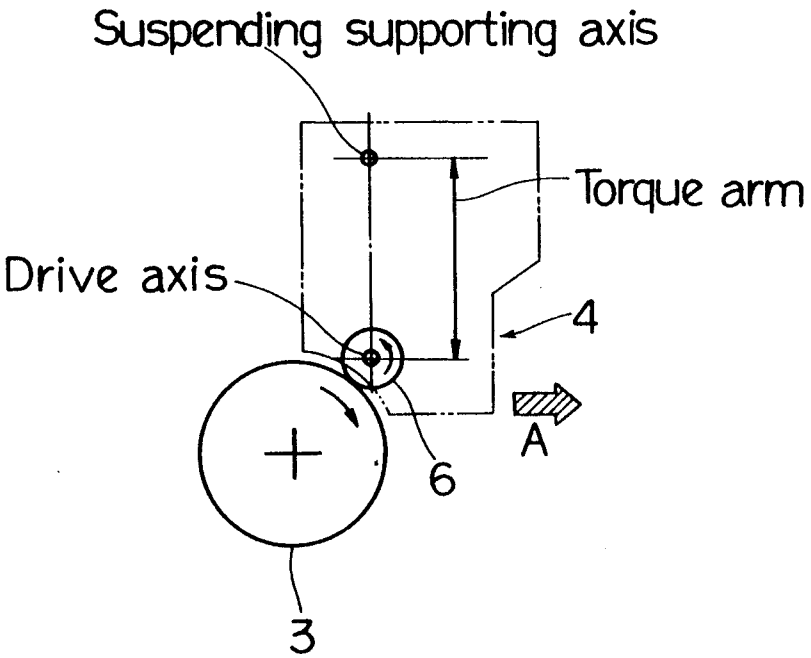
Fig.3(a) PRIOR ART
Figure 3B:
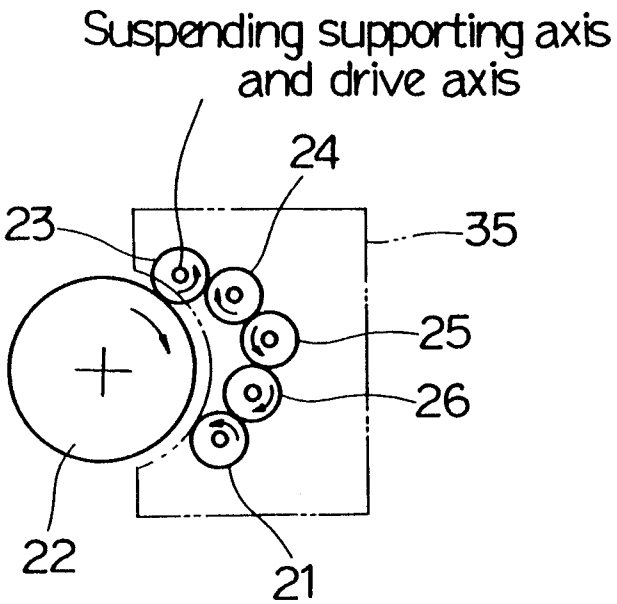
Fig.3(b) PRIOR ART
Figure 4:
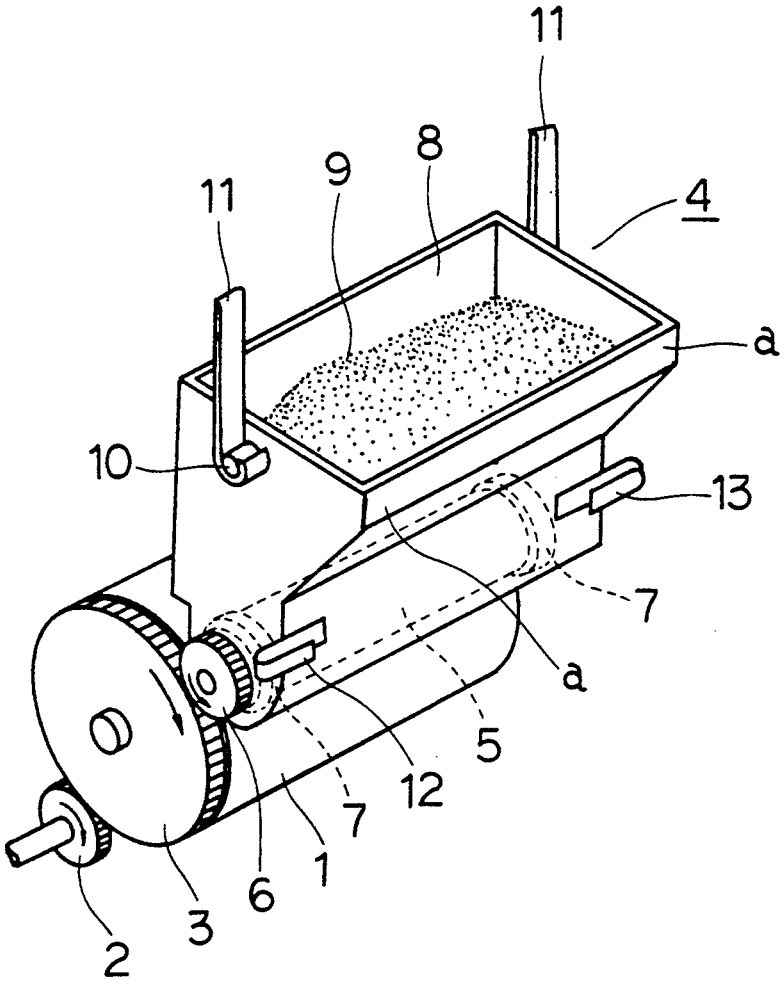
Fig. 4 PRIOR ART
FIG. 4 is a perspective view of a conventional example.

FIG. 3 shows a conventional example (a) and the present preferred embodiment (b) symmetrically. However, in the conventional example (a), the distance between the suspending supporting axis and the drive axis is large, and as the drive axis gear 6 receives a drive force by a gear 3 of the photosensitive drum, the drive axis gear 6 rotates in the direction of an illustrated arrow, so that the distance between the suspending supporting axis and the drive axis acts as large torque arm. Then, such a force as keeping the developing device 4 away in the direction of an arrow A acts to cause the interval of the development treatment portion consisting of photosensitive drum and developing roller to be fluctuated due to a drive force.

On the other hand, in the present preferred embodiment shown in FIG. 3(*b*), the suspending supporting axis is identical to the drive axis. Therefore, it is equivalent to that the above torque arm does not exist, and even though the drive axis gear 23 is given a drive force from the photosensitive drum 22 and rotates in the direction of an illustrated arrow, the force which tries to keep the developing unit 35 away from is remarkably small. Furthermore, drive force to cause the developing roller to rotate is transmitted to the developing roller gear 21 by way of the gears 23, 24, 25 and 26, and the direction of rotation thereof is reversed each other. Therefore, the force which tries to keep the developing unit 35 away due to drive force can be dispersed.

What is claimed is:

1. A developing device constructed so that rotational force of a photosensitive drum is transmitted to a developing roller supported at a developing unit which is provided confronting the photosensitive drum, said developing unit comprising:

a drum gear which rotates integrally with the photosensitive drum arranged coaxially with a rotational axis of the photosensitive drum is provided on a side wall of the photosensitive drum, a transmission gear which is directly engaged with the drum gear is rotatably supported at a supporting axis arranged in parallel to and spaced from the rotational axis of the photosensitive drum, the developing unit confronting to the photosensitive drum is rockably axially supported at the supporting axis, a roller drive gear which is arranged coaxially with the rotational axis of the developing roller and rotates integrally with the developing roller is provided on a side wall of the developing unit at the side to which the transmission gear of the developing unit is attached, an odd number of gears which link between the roller drive gear and the transmission gear are rotatably provided on the side wall of the developing unit at the side where transmission gear and roller drive gear are attached, and energizing means which energizes the developing roller toward the photosensitive drum is provided at the developing unit.

2. A developing device defined in claim 1, wherein the developing device has a recess in which the outer circumferential face of the photosensitive drum is received at the side confronting to the photosensitive drum.

3. A developing device defined in claim 1, wherein the supporting axis is arranged in vicinity of the surface of the upper side portion in a direction perpendicular to the photosensitive drum.

4. A developing device defined in claim 1, wherein the supporting axis is arranged and offset to the side of the photosensitive drum in the horizontal direction of the developing unit at the upper side portion in a direction perpendicular to the developing unit.

5. A developing device defined in claim 1, wherein the plurality of gears are arranged in a hook-like pattern, centering around the middle gear.

6. A developing device defined in claim 1, wherein a developing system of the developing unit is of direct compression type.

* * * * *